US005447204A

United States Patent [19]

Asal et al.

[11] Patent Number: 5,447,204

[45] Date of Patent: Sep. 5, 1995

[54] BULLDOZER ASSEMBLY WITH ANGLE, TILT AND PITCH CONTROL

[75] Inventors: Jerrold R. Asal; David J. Balzer, both of Peoria; Darryl J. Brincks, East Peoria; Robert L. Isaia, Roanoke; Kent D. Smith, Mapleton, all of Ill.

[73] Assignee: Caterpillar Inc., Peoria, Ill.

[21] Appl. No.: 126,957

[22] Filed: Sep. 24, 1993

[51] Int. Cl.[6] ..... E02F 3/76

[52] U.S. Cl. ..... 172/821

[58] Field of Search ..... 172/816, 817, 818, 819, 172/820, 821, 822, 823, 824, 825, 826, 827, 779, 762, 763, 792

[56] References Cited

U.S. PATENT DOCUMENTS

| | | | |
|---|---|---|---|
| 2,311,553 | 2/1943 | Tourneau | 37/144 |
| 2,749,630 | 4/1951 | Nave | 37/144 |
| 3,059,356 | 10/1962 | Lorang | 37/144 |
| 3,521,714 | 7/1970 | Farris | 172/804 |
| 3,631,930 | 1/1972 | Peterson | 172/804 |
| 3,690,386 | 9/1972 | Magee | 172/821 |
| 3,991,832 | 11/1976 | Cooper | 172/804 |
| 4,081,036 | 3/1978 | Yokoyama | 172/804 |
| 4,241,794 | 12/1980 | Halterman, Jr. | 172/804 |
| 4,364,439 | 12/1982 | Asal | 172/821 |
| 4,638,869 | 1/1987 | Murphy et al. | 172/821 |
| 4,893,683 | 1/1990 | Horsch et al. | 172/821 |

*Primary Examiner*—Randolph A. Reese

*Assistant Examiner*—Frederick L. Lagman

*Attorney, Agent, or Firm*—J. W. Burrows

[57] ABSTRACT

It is desirable in many applications to have a bulldozer assembly that can be angled and/or tilted without having interference between elements of the bulldozer assembly and the machine on which it is mounted. In the subject arrangement, a bulldozer assembly has a blade connected to a U-shaped frame through a universal connector. The blade is angled by a pair of angle cylinders connected between the U-shaped frame and a pair of spaced apart angle cylinder brackets located on the blade. The universal connector is connected to the blade generally midway between the pair of spaced apart angled cylinder brackets and generally aligned therewith. The pitch of the blade is maintained at a preselected position by a pitch control mechanism and mechanically adjusted by the pitch control mechanism. Since the pair of spaced apart angle cylinder brackets and the universal connecting joint bracket are in general transverse alignment and the universal connecting bracket is located generally midway therebetween, any angling and/or tilting of the blade permits the pair of angle cylinders to remain generally along their neutral axis. The subject arrangement provides freedom of angling and tilting of the blade without interference between elements of the bulldozer assembly and the machine.

9 Claims, 4 Drawing Sheets

BULLDOZER ASSEMBLY WITH ANGLE, TILT AND PITCH CONTROL

TECHNICAL FIELD

This invention relates generally to a bulldozer assembly and more particularly to a bulldozer assembly having power angling and power tilting.

BACKGROUND ART

Bulldozer assemblies known in the art are designed to perform various functions. For example, they are designed for bulldozing a flat surface wherein the material is pushed in front of the bulldozer assembly. In other arrangements, the bulldozer assembly is designed so that a blade of the bulldozer assembly can be angled in one direction or the other with respect to its travel path, thus, directing the materials to one side or the other of the travel path of the bulldozer assembly. Furthermore, in many arrangements the blade of the bulldozer assembly is angled plus it can also be tilted. In bulldozer assemblies that provide both blade angling and blade tilting, it is advantageous to provide an arrangement that maintains the blade close to the machine on which it is mounted while prohibiting the angling cylinders or other components from interfering with structure on a machine.

In the bulldozer assemblies noted above, the blade of the bulldozer assembly is secured in a position so that the pitch, defined as the fore/aft relationship of the top of the blade with respect to the bottom thereof or as the angle of the cutting edge thereof with the ground, of the blade is maintained at a fixed position. In various other arrangements, the pitch of the blade is adjusted either mechanically or by various other means, such as hydraulic actuation. In these arrangements, it is likewise advantageous to provide a structure that, when changing the pitch of the blade while angling and/or tilting, prohibits the structure of the bulldozer assembly from interfering with the machine on which it is mounted.

The word tilt, as used herein with respect to the blade, means the raising or lowering of one end of the blade relative to the center of the blade. Angling of the blade means pivoting the end of the blade forwardly or rearwardly about the center portion of the blade. Pitching of the blade means moving the top or the bottom of the blade forwardly or rearwardly.

The present invention is directed to overcoming one or more of the problems as set forth above.

DISCLOSURE OF THE INVENTION

In one aspect of the present invention, a bulldozer assembly is provided having a U-shaped frame with a tower extending upwardly from a mid portion thereof, a pair of angle cylinder connecting joints disposed on the legs of the U-shaped frame, a universal connecting joint disposed on the upwardly extending tower, a pitch connecting joint disposed on the frame elevationally below the universal connecting joint and a tilt connecting joint disposed on the tower elevationally above the universal connecting joint. The bulldozer assembly includes a blade having a pair of spaced apart angle cylinder brackets transversely disposed thereon, a universal connecting bracket disposed generally midway between and aligned with the pair of angle cylinder brackets, a pitch connecting bracket disposed elevationally below the universal connecting bracket and a tilt cylinder bracket disposed on an end portion thereof elevationally higher than the universal connecting bracket. A pair of angle cylinders are provided in the bulldozer assembly connected between the respective angle cylinder connecting joints on the frame and the respective angle cylinder brackets on the blade. A universal connector interconnects the universal connecting joint on the tower of the frame with the universal connecting bracket on the blade and is provided in the bulldozer assembly along with a tilt cylinder connected between the tilt connecting joint on the tower of the frame and the tilt cylinder bracket on the blade. The bulldozer assembly further includes a pitch control mechanism connected between the pitch connecting joint on the frame and the pitch connecting bracket on the blade.

The present invention provides a bulldozer assembly that is operational to angle the blade with respect to the U-shaped frame, tilt the blade, and maintain a constant pitch of the blade free from interference between the machine that it is mounted on and the elements of the bulldozer assembly.

BEST MODE FOR CARRYING OUT THE INVENTION

Figure 1:
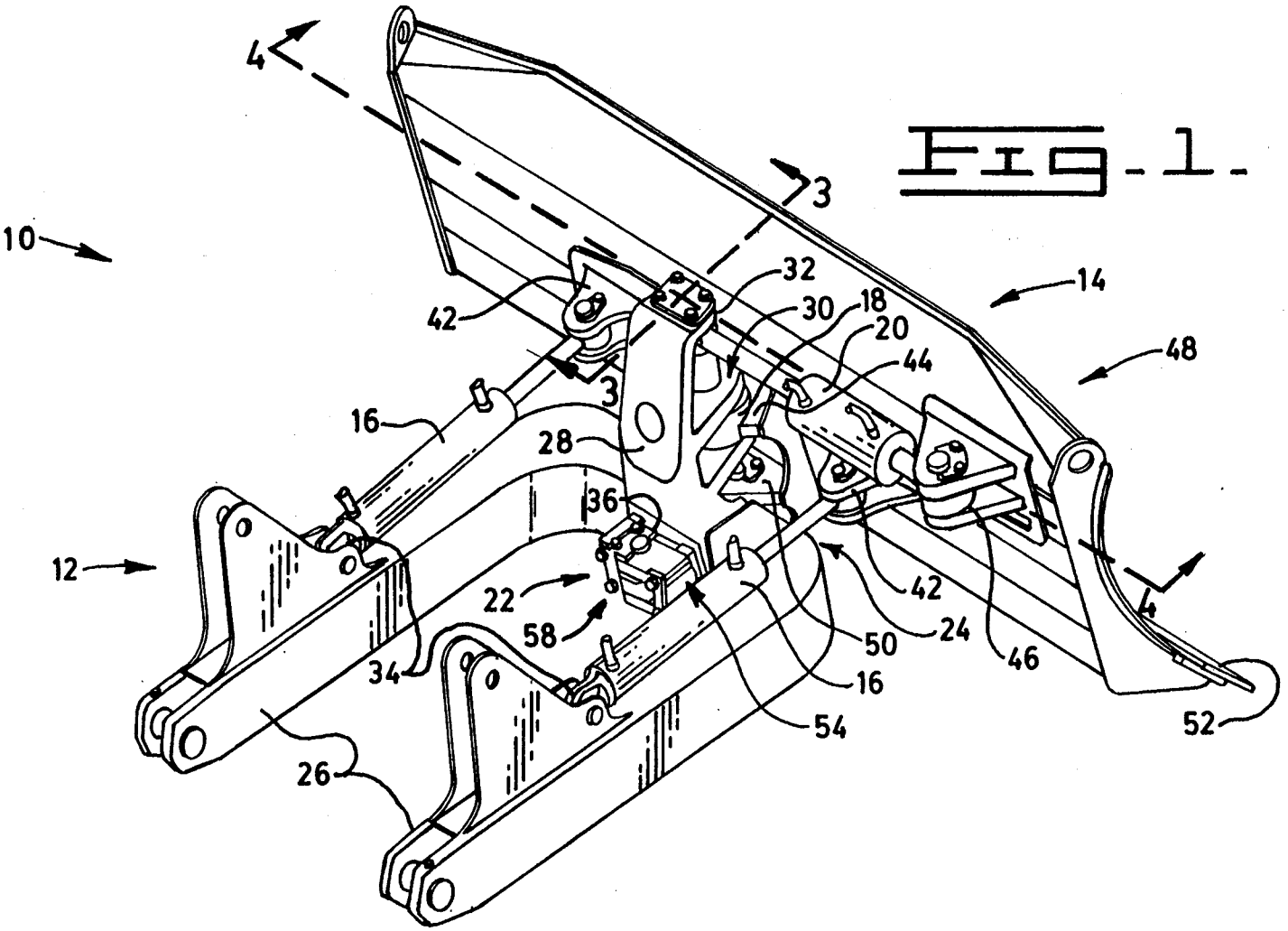
FIG. 1 is a isometric view of an embodiment incorporating the subject invention.
Figure 2:
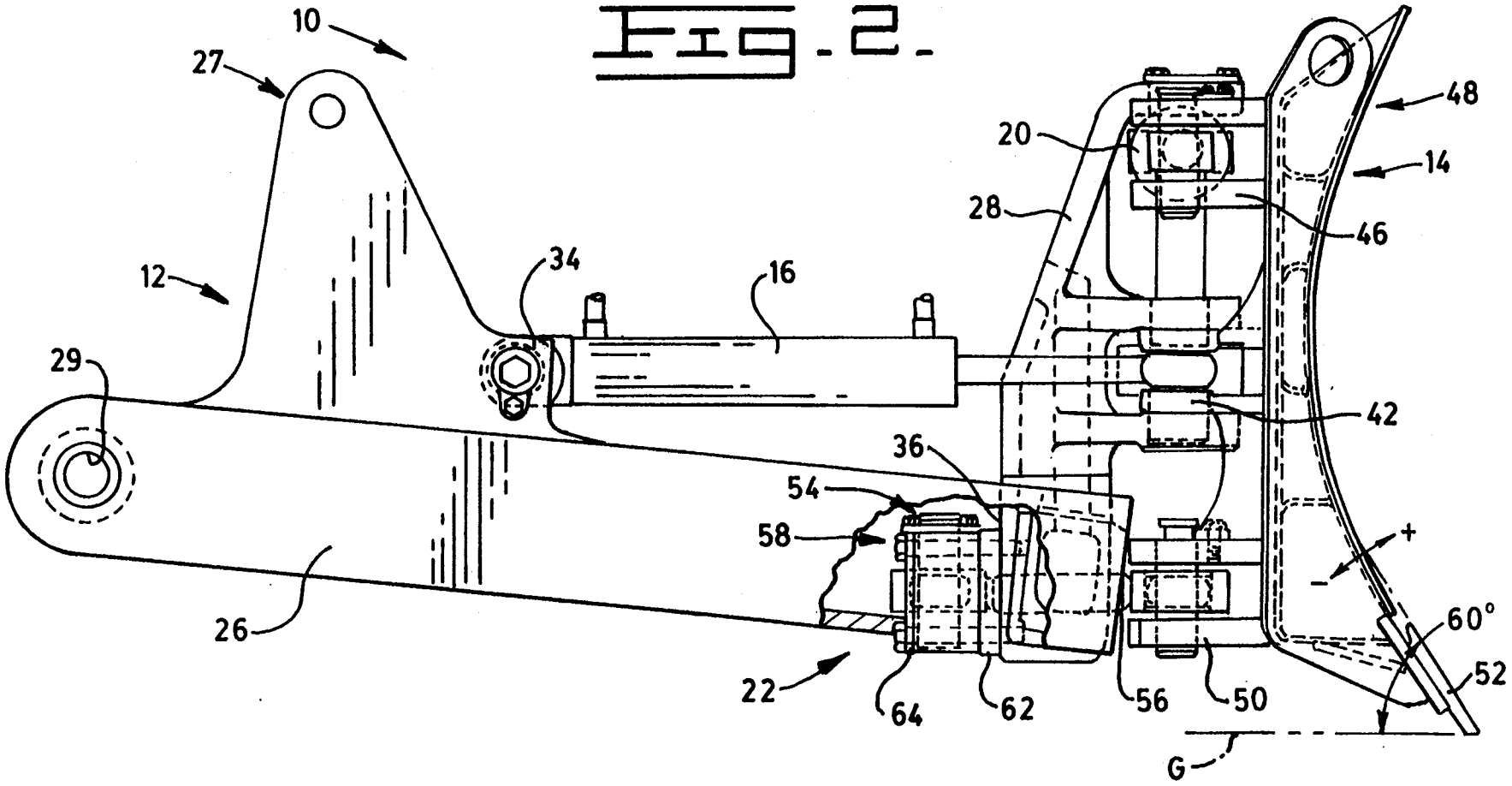
FIG. 2 is a side elevational view of FIG. 1 with a portion thereof broken away.
Figure 3:
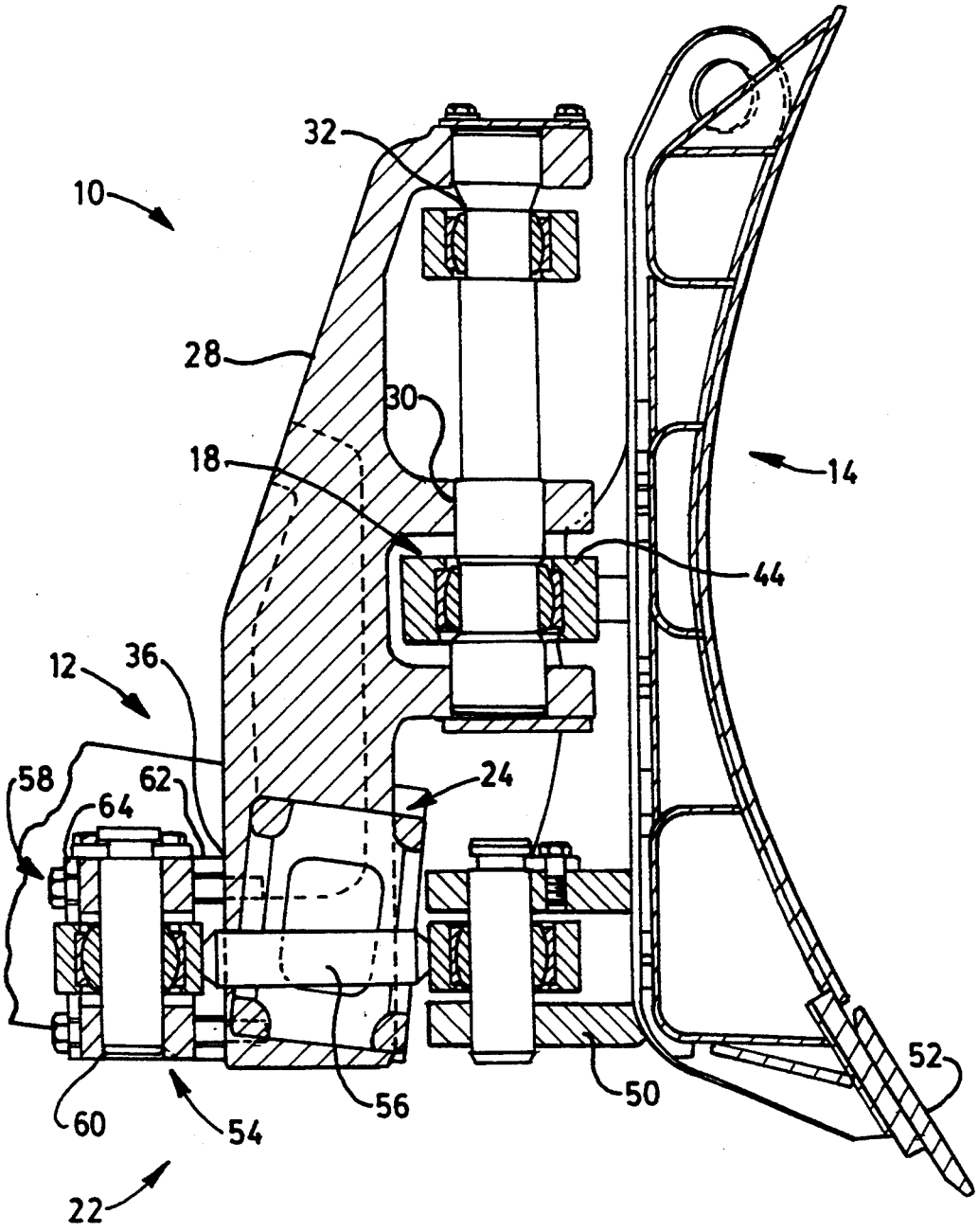
FIG. 3 is a cross-sectional view taken along the line 3—3 of FIG. 1.
Figure 4:
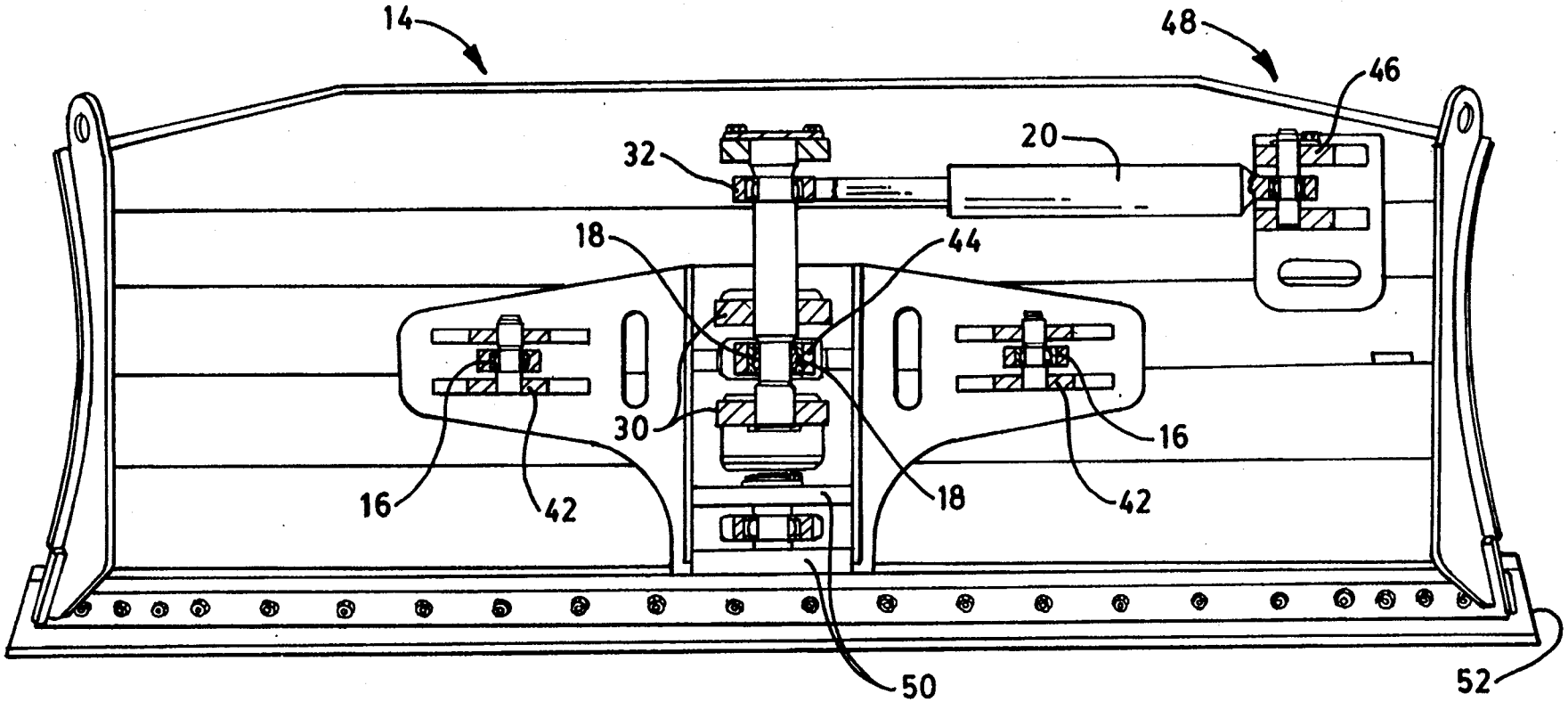
FIG. 4 is a cross-sectional view taken along the line 4—4 of FIG. 1.

Referring to the drawings, a bulldozer assembly 10 is shown and adapted for connection to a machine (not shown). The bulldozer assembly 10 includes a U-shaped frame 12, a blade 14, a pair of angle cylinders 16, a universal connector 18, a tilt cylinder 20, and a pitch control mechanism 22.

The U-shaped frame 12 has a mid portion 24, a pair of leg portions 26, a pair of lift mounting arms 27 and a tower 28 extending upwardly from the mid portion 24. A pair of machine mounting joints 29 are located on the ends of the leg portions 26 and adapted for connection to the machine. A universal connecting joint 30 and a tilt connecting joint 32 are disposed on the tower 28. The tilt connecting joint 32 is located elevationally above the universal connecting joint 30. As illustrated in the drawings, the universal connecting joint 30 and the tilt connecting joint 32 are generally vertically aligned. It is recognized, however, that the tilt connecting joint 32 does not have to be vertically aligned with the universal connecting joint 30.

A pair of angle cylinder connecting joints 34 are disposed on the U-shaped frame 12 and are located on the pair of leg portions 26. A pitch connecting joint 36 is disposed on the U-shaped frame 12 and located on the mid portion 24 thereof elevationally below the universal connecting joint 30.

The blade 14 has a pair of spaced apart angle cylinder brackets 42 disposed thereon transversely spaced and located generally midway between the top and bottom of the blade. A universal connecting bracket 44 is disposed on the blade 14 generally midway between and aligned with the pair of angle cylinder brackets 42 and generally midway between the top and bottom of the blade 14. A tilt cylinder bracket 46 is located on an end portion 48 of the blade and disposed thereon elevationally above the universal connecting bracket 44. A pitch connecting bracket 50 is disposed on the blade 14 and located elevationally below the universal connecting bracket 44. A cutting edge 52 is disposed on the front of the blade 14 along the bottom thereof and forms an angle of approximately 60 degrees with respect to a surface "G" of the ground.

The pair of angle cylinders 16, as illustrated, are connected between respective ones of the pair of angle cylinder connecting joints 34 on the U-shaped frame 12 and the pair of spaced apart angle cylinder brackets 42 on the blade 14. The universal connector 18 interconnects the universal connecting joint 30 of the U-shaped frame 12 to the universal connecting bracket 44 of the blade 14. Likewise, the tilt cylinder is connected between the tilt connecting joint 32 of the U-shaped frame 12 and the tilt cylinder bracket 46 of the blade 14.

The pitch control mechanism 22 is connected between the pitch connecting joint 36 of the U-shaped frame 12 and the pitch connecting bracket 50 of the blade 14. The pitch control mechanism 22 is adjustable in order to vary the pitch of the blade 14 from its normal, preset position to a positive or negative pitch. As illustrated, the pitch control mechanism 22 is a mechanically adjusted mechanism and includes an adjustable mounting bracket 54 and a solid link 56. The adjustable mounting bracket 54 is releasably connected to the frame by a fastener mechanism 58. The adjustable mounting bracket 54 includes a connector pin assembly 60, a first, thick shim 62 of a predetermined thickness located between the connector pin assembly 60 and the pitch connecting joint 36, and a second, thin shim 64 of a predetermined thickness located between the fastener mechanism 58 and the connector pin assembly 60. The thickness of the second shim 64 is less than the thickness of the first shim 62.

It is recognized that various forms of the bulldozer assembly 10 could be utilized without departing from the essence of the invention. For example, the U-shaped frame 12 could have other shapes, i.e., C-shaped, box beams with corner supports, etc. Even though the subject invention discloses and teaches only two shims, it is recognized that several different shims of varying thicknesses could be utilized without departing from the essence of the invention.

Industrial Applicability

In the operation of the bulldozer assembly 10, the U-shaped frame 12 thereof is connected to the machine by the pair of machine mounting joints 29 and the bulldozer assembly is raised and/or lowered in a well known manner by hydraulic cylinders (not shown) connected between the lift mounting arms 27 and the machine. During angling of the blade 14, as is well known, one angle cylinder of the pair of angle cylinders 16 is extended while the other angle cylinder is retracted. The respective extension and retraction of the pair of angle cylinders 16 result in the blade 14 pivoting about the universal connector 18. Likewise, extension of the tilt cylinder 20 results in the end portion 48 of the blade 14 raising or tilting upwardly as a result of the blade 14 pivoting about the universal connector 18. Since the universal connector 18 is located generally midway between and aligned with the pair of angle cylinder connecting joints 34, the pair of angling cylinders 16 remain close to their initial or neutral axis position and do not interfere with components of the machine. Likewise, when the blade 14 is angled and/or tilted, the pair of angled cylinders 16 remain close to their neutral axis, thus, eliminating the possibility of interference between the bulldozer assembly 10 and the machine. When the blade 14 is being angled and/or tilted, the pitch control mechanism 22 maintains the blade 14 in its preset position. As illustrated in the subject embodiment, the preset position of the blade 14 is its normal, zero pitch position with the cutting edge 52 thereof at the approximately 60 degree angle with respect to the surface "G" of the ground. Any increase in this angle provides a positive pitch "+" of the blade 14 and any decrease in the angle provides a negative pitch "−" thereof.

As illustrated in the drawings, the first, thick shim 62 is located in a normal, operative position on the forward, front side of the connector pin assembly 60 adjacent the pitch connecting joint 36. The second, thin shim 64 is located in a stored position on the opposite side of the connector pin assembly 60 away from the pitch connecting joint 36.

In order to vary the pitch of the blade 14, the fastening mechanism 58 is loosened and the thick shim 62 is removed from the normal operative position and relocated rearwardly to the stored position adjacent the thin shim 64. This relocation produces a positive pitch of the blade 14. Alternatively, the thin shim 64 is removed from the stored position and relocated forwardly to the operative position adjacent the thick shim 62. This relocation produces a negative pitch of the blade 14. Following the desired relocation of the thick shim 62 and/or the thin shim 64, the fastening mechanism 58 is retightened.

The positive pitch of the blade 14 is produced by locating the thick shim 62 and the thin shim 64 on the side of the connector pin assembly 60 adjacent the U-shaped frame 12 which, due to the solid link 56, effectively moves the bottom of the blade 14 rearwardly with respect to the top of the blade 14. The positive pitch of the blade is approximately 2 degrees. Therefore, the cutting edge 52 is angled approximately 62 degrees with respect to the surface "G" of the ground.

The negative pitch of the blade 14 is produced by locating the thick shim 62 and the thin shim 64 both in the stored position which, due to the solid link 56, effectively moves the bottom of the blade 14 forwardly with respect to the top of the blade 14. The negative pitch of the blade 14 is approximately 6 degrees. Therefore, the cutting edge 52 is angled approximately 54 degrees with respect to the surface "G" of the ground.

By simply exchanging the position of the thick shim 62 with that of the thin shim 64, a negative pitch for the blade 14 of approximately 2 degrees is obtained. As previously noted, various numbers of shims and/or thicknesses of shims could be used to obtain various other positive or negative pitch angles of the blade 14 without departing from the essence of the invention.

In view of the foregoing, it is readily apparent that the structure of the present invention provides a bulldozer assembly having a blade that is maintained close to the machine and that can be angled and/or tilted, while maintaining a constant pitch. Furthermore, as needed, the pitch of the blade 14 can be mechanically adjusted. During operation, the subject bulldozer assembly is free from interference with the machine that it is mounted on.

Other aspects, objects, and advantages of this invention can be obtained from a study of the drawings, the disclosure and the appended claims.

We claim:

1. A bulldozer assembly, comprising:

a U-shaped frame having a pair of leg portions, a tower extending upwardly from a mid portion thereof, a pair of angle cylinder connecting joints disposed on the respective leg portion of the U-shaped frame, a universal connecting joint disposed on the upwardly extending tower, a pitch connecting joint disposed on the frame elevationally below the universal connecting joint, and a tilt connecting joint disposed on the tower elevationally above the universal connecting joint;

a blade having a pair of spaced apart angle cylinder brackets transversely disposed thereon, a universal connecting bracket disposed generally midway between and aligned with the pair of angle cylinder brackets, a pitch connecting bracket disposed elevationally below the universal connecting bracket, and a tilt cylinder bracket disposed on an end portion thereof elevationally higher than the universal connecting bracket;

a pair of angle cylinders connected between the respective angle cylinder connecting joints on the frame and the respective angle cylinder brackets on the blade;

a universal connector interconnecting the universal connecting joint on the tower of the frame with the universal connecting bracket on the blade;

a tilt cylinder connected between the tilt connecting joint on the tower of the frame and the tilt cylinder bracket on the blade;

a pitch control mechanism connected between the pitch connecting joint on the frame and the pitch connecting bracket on the blade; and wherein the pair of angle cylinder brackets and the universal connecting bracket are located on the blade generally midway between the top and the bottom of the blade.

2. The bulldozer assembly of claim 1 wherein the universal connecting joint and the tilt connecting joint are substantially in vertical alignment.

3. The bulldozer assembly of claim 1 wherein the pitch control mechanism is adjustable.

4. The bulldozer assembly of claims 3 wherein the adjustment of the pitch control mechanism is mechanical.

5. The bulldozer assembly of claim 4 wherein the mechanically adjustable pitch control mechanism includes an adjustable mounting bracket releasably connected to the frame and a solid link connected between the adjustable mounting bracket and the pitch connecting bracket on the blade.

6. The bulldozer assembly of claim 5 wherein the adjustable mounting bracket includes a connector pin assembly operative to connect the solid link to the adjustable mounting bracket, a shim having a predetermined thickness disposed between the connector pin assembly and the frame and a fastener mechanism operative to secure the adjustable mounting bracket to the U-shaped frame.

7. The bulldozer assembly of claim 6 wherein the adjustable mounting bracket includes a second shim having a predetermined thickness that is less than the predetermined thickness of the first shim, the first shim and the second shim being selectively positionable between the connector pin assembly and the frame and operative to change the pitch of the blade.

8. The bulldozer assembly of claim 7 wherein the first shim and the second shim are stored adjacent the connector pin on the side thereof opposite from the frame when not being used between the connector pin assembly and the frame.

9. A bulldozer assembly, comprising:

a U-shaped frame having a pair of leg portions, a tower extending upwardly from a mid portion thereof, a pair of angle cylinder connecting joints disposed on the respective leg portion of the U-shaped frame, a universal connecting joint disposed on the upwardly extending tower, a pitch connecting joint disposed on the frame elevationally below the universal connecting joint, and a tilt connecting joint disposed on the tower elevationally above the universal connecting joint;

a blade having a pair of spaced apart angle cylinder brackets transversely disposed thereon, a universal connecting bracket disposed generally midway between and aligned with the pair of angle cylinder brackets, a pitch connecting bracket disposed elevationally below the universal connecting bracket, and a tilt cylinder bracket disposed on an end portion thereof elevationally higher than the universal connecting bracket;

a pair of angle cylinders connected between the respective angle cylinder connecting joints on the frame and the respective angle cylinder brackets on the blade;

a universal connector interconnecting the universal connecting joint on the tower of the frame with the universal connecting bracket on the blade;

a tilt cylinder connected between the tilt connecting joint on the tower of the frame and the tilt cylinder bracket on the blade; and a mechanically adjustable pitch control mechanism connected between the pitch connecting joint on the frame and the pitch connecting bracket on the blade, including an adjustable mounting bracket releasably connected to the frame and a solid link connected between the adjustable mounting bracket and the pitch connecting bracket on the blade.

* * * * *